US007143452B1

(12) United States Patent
Rossini

(10) Patent No.: US 7,143,452 B1
(45) Date of Patent: Dec. 5, 2006

(54) MULTIPURPOSE HELMET CAMOUFLAGE SYSTEM

(76) Inventor: Michael J. Rossini, 169 Everett St., Apt. 3, Quincy, MA (US) 02169

( * ) Notice: Subject to any disclaimer, the term of this patent is extended or adjusted under 35 U.S.C. 154(b) by 39 days.

(21) Appl. No.: 10/903,820

(22) Filed: Aug. 2, 2004

(51) Int. Cl.
*A42B 1/24* (2006.01)
*F41H 1/04* (2006.01)

(52) U.S. Cl. ..... 2/209.13; 2/6.6; 2/175.6; 2/900; 2/909

(58) Field of Classification Search ..... 2/6.6, 2/4, 6.7, 205, 207, 175.6, 900, 172, 908, 2/909, 918, 422, 209.13; 428/919
See application file for complete search history.

(56) References Cited

U.S. PATENT DOCUMENTS

| | | | | |
|---|---|---|---|---|
| 766,426 | A | 8/1904 | Constook | |
| 859,736 | A | 7/1907 | Brown | |
| 1,268,223 | A | 6/1918 | Eimer | |
| 1,450,379 | A | 4/1923 | McNary | |
| 1,581,750 | A | 4/1926 | Mantilla | |
| 2,351,142 | A * | 6/1944 | Meldon | 428/136 |
| 2,434,873 | A * | 1/1948 | Tessier | 2/4 |
| 2,472,033 | A | 5/1949 | Wetzel | |
| 2,911,652 | A | 11/1959 | Ekman | |
| 3,015,104 | A | 1/1962 | Crosson et al. | |
| 3,100,896 | A | 8/1963 | Khanebegian | |
| 3,146,462 | A | 9/1964 | Militello | |
| 3,479,666 | A | 11/1969 | Webb | |
| 4,106,124 | A | 8/1978 | Green | |
| 4,214,318 | A * | 7/1980 | Gomez | 2/4 |
| 4,285,068 | A | 8/1981 | Ross | |
| 4,575,871 | A | 3/1986 | Auerbach et al. | |
| 5,281,460 | A * | 1/1994 | Cox | 428/112 |
| D346,893 | S * | 5/1994 | St-Germain | D2/866 |
| 5,603,117 | A | 2/1997 | Hudner, Jr. et al. | |
| 5,638,544 | A | 6/1997 | Sump | |
| 5,652,963 | A | 8/1997 | Davison | |
| 5,713,076 | A * | 2/1998 | Davis | 2/4 |
| 6,127,007 | A | 10/2000 | Cox et al. | |
| 6,233,738 | B1 * | 5/2001 | Siracusa | 2/4 |
| 6,256,799 | B1 | 7/2001 | McGlasson et al. | |
| 6,266,824 | B1 | 7/2001 | Giansanti | |
| 6,298,492 | B1 | 10/2001 | Stirling | |
| 2005/0086723 | A1 * | 4/2005 | Hsieh | 2/173 |

FOREIGN PATENT DOCUMENTS

DE 3112924 A1 * 10/1982

* cited by examiner

*Primary Examiner*—Rodney M. Lindsey
(74) *Attorney, Agent, or Firm*—John P. McGonagle

(57) ABSTRACT

An elasticized, weatherproof assembly adapted to being attached to a military helmet. Foliage and the like available for the surrounding terrain may be inserted into the assembly at points over the entire helmet. The present invention also provides a face and bug net attachable to said helmet assembly. The face and bug net may be stored in a rolled up position onto the helmet assembly or deployed. In the deployed state the face and bug net is rolled down over the face and neck, thereby camouflaging the face and neck while also providing bug protection. The present invention also provides a bundle of camouflage strips stored attached to the apex of the helmet assembly. In a deployed state, the camouflage strips extend downward over the helmet.

9 Claims, 4 Drawing Sheets

MULTIPURPOSE HELMET CAMOUFLAGE SYSTEM

BACKGROUND OF THE INVENTION

This invention relates to military helmets, and in particular to a camouflage system for military helmets.

Military helmets have historically been camouflaged by using nets placed on helmets. Vegetation, brush, branches, and the like, are snagged onto or inserted through the netting to camouflage the helmet.

The standard United States military helmet currently in use is made of KEVLAR aramid fiber material and includes a dome having an outer surface, an inner surface, and a rim, which, along with the inner surface defines a cavity for receiving the wearer's head. Such a helmet has an upper portion and an expanded lower portion extending from the upper portion to the rim. These helmets are typically covered with a fabric camouflage cover having slits therein for receiving camouflage elements and an elastic perimeter strap for securing the cover. Any additional camouflage requirements are met through the use of foliage attached between the strap and helmet.

The present day military helmet has certain camouflage limitations. It is inevitable that certain terrain will fail to provide any natural foliage whereby such covers are virtually useless when seen in silhouette. When natural foliage is available, the user must spend considerable time plucking natural foliage and applying it to the cover. With just a strap to hold the camouflage materials to the helmet, it is also difficult to cover and/or break up the entire helmet silhouette.

SUMMARY OF THE INVENTION

The present invention overcomes the limitations of present day military helmet camouflage systems, by providing a system which provides camouflage over the entire helmet, regardless of the availability of natural foliage. The present invention overcomes the limitations of the prior art by providing an elasticized, weatherproof assembly adapted to being attached to a military helmet. Foliage and the like available for the surrounding terrain may be inserted into the assembly at points over the entire helmet. The present invention also provides a face and bug net attachable to said helmet assembly. The face and bug net may be stored in a rolled up position onto the helmet or deployed. In the deployed state the face and bug net is rolled down over the face and neck, thereby camouflaging the face and neck while also providing bug protection. The present invention also provides a bundle of camouflage strips stored attached to the apex of the helmet assembly. In a deployed state, the camouflage strips extend downward over the helmet. Thus, three-dimensional camouflage is available regardless of the availability of local terrain. The camouflage strips may be matched with the features of the local area where the soldier is to be deployed, i.e., desert, snow, woods, jungle, etc.

A primary objective, therefore, of the present invention is to provide a soldier the ability to rapidly deploy three-dimensional camouflage that will quickly render his/her upper head and torso an indistinguishable form.

Another objective of the present invention is to provide a soldier with the ability to rapidly store and/or hold tools, first aid, illumination devices, and the like, on his or her helmet.

Another objective of the present invention is to provide a soldier with the ability to rapidly deploy a lightweight camouflage assembly that will readily offer additional exposure protection while offering increased glare reduction insect protection and aid in the concealment of the head, face and neck.

Another objective of the present invention is to provide a soldier with the ability to rapidly install, and/or remove, a 3D camouflage system on his or her helmet.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 2:
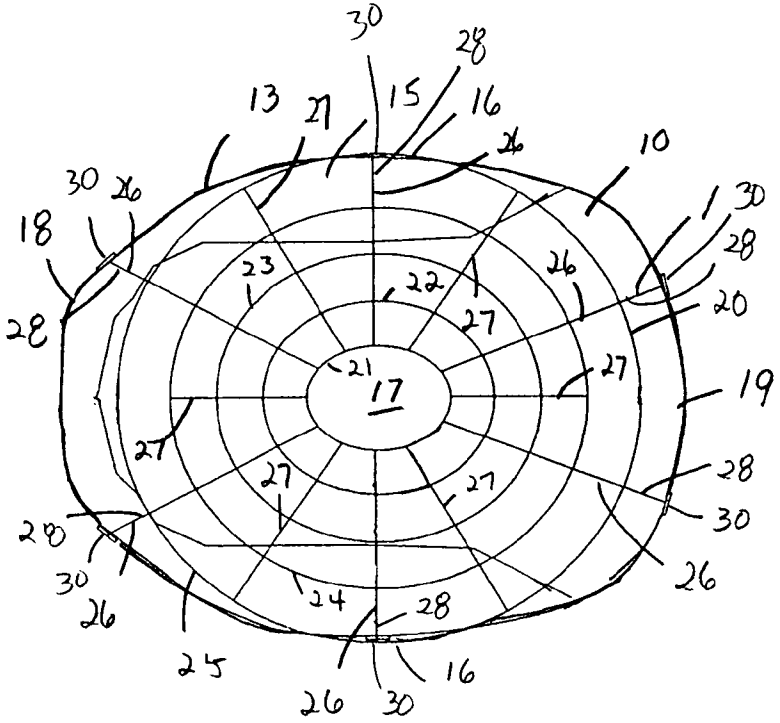
FIG. 2 is a top view of the helmet of FIG. 1.
Figure 1:
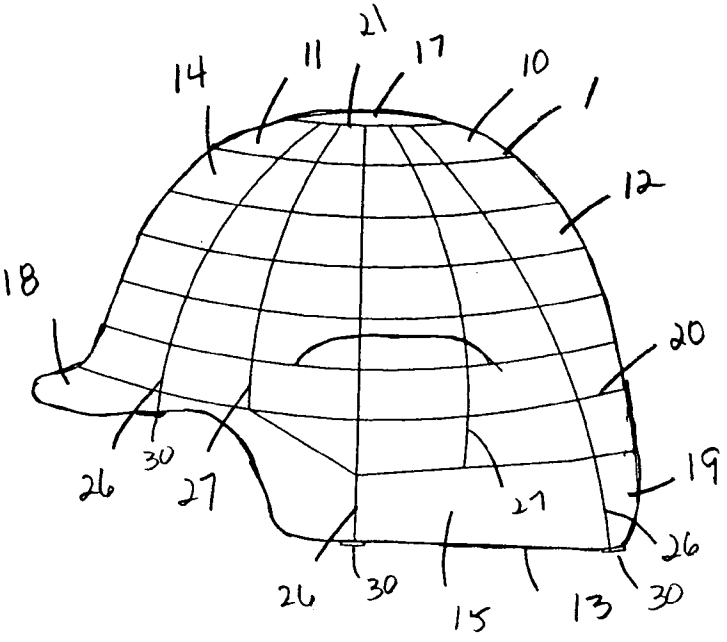
FIG. 1 is a side view of a helmet with an invention elasticized assembly.
Figure 3:
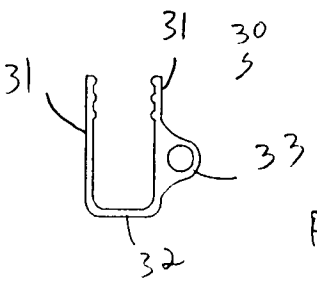
FIG. 3 is a side view of a retaining clip.

Referring to the drawings in detail wherein like elements are indicated by like numerals, there is shown an embodiment of a helmet camouflage system 1 constructed according to the principles of the present invention. The camouflage system 1 of the present invention is used in conjunction with a military helmet 10. The helmet 10 generally comprises a dome 11 having an outer surface 12 and an inner surface (not shown). A rim 13, along with the inner surface of the dome 11, defines a cavity (not shown) for receiving a wearer's head. The dome 11 includes an upper portion 14 which fits over the top of a wearer's head and an expanded portion 15 extending from the upper portion 14 of the dome to the rim 13 for covering the sides, forehead and back of the wearer's head. The helmet 10 has a forward portion 18 for covering the wearer's forehead, a rearward portion 19 for covering the back of the wearer's head, and opposing sides 16 extending between the forward portion 18 and rearward portion 19 to protect the sides of the wearer's head.

The helmet camouflage system 1 of the present invention is comprised of an elasticized, weatherproof assembly 20 adapted to be attached to the military helmet 10. In a preferred embodiment, the assembly 20 has a spider web form beginning with a first ring 21 adjacent to and about the helmet apex 17. A second ring 22 is then formed beneath the first ring 21 about the helmet dome upper portion 14. A third ring 23 is then formed beneath the second ring 22 about the helmet dome upper portion 14. A fourth ring 24 is then formed beneath the third ring 23 about the helmet dome upper portion 14. A fifth ring 25 is then formed beneath the fourth ring 24 about the helmet expanded portion 15.

The rings 21–25 are interconnected by twelve lines, six helmet connector lines 26 and six ring connector lines 27, all of which begin at the first ring 21. Each of the lines 26, 27 interconnect each of the rings 21–25. One helmet connector line 26 and two ring connector lines 27 move from the first ring 21 toward an opposing side 16. Two helmet connector lines 26 and one ring connector line 27 move from the first ring 21 toward the forward portion 18. Two helmet connector lines 27 and one ring connector line 27 move from the first ring 21 toward the rearward portion 19. The ring connector lines 27 terminate at the fifth ring 25. The helmet connector lines 26 have a portion 28 extending past the fifth ring 25 toward the helmet rim 13. The connector line extending portions 28 all terminate in a U-shaped retaining clip 30 comprised of two legs 31 interconnected by a crossbar 32. An eyelet 33 is formed on one of the clip legs 31. The helmet connector line extending portions 28 terminate in the clip eyelet 33. The clips 30 are fitted about the helmet rims 13, one clip leg 31 engaging the helmet outer surface 12 and the other leg 31 engaging the helmet inner surface. The elastic tension of the assembly 20 holds the clips 30 in place about the helmet rims 13. Other invention embodiments may have more or less rings and more or less connector lines, and form other unique web formations. However, six helmet connector lines appear to work the best. Although this embodiment has all connector lines beginning at the first ring, other embodiments may have the connector lines continue across the first ring over the helmet apex 17.

Figure 5:
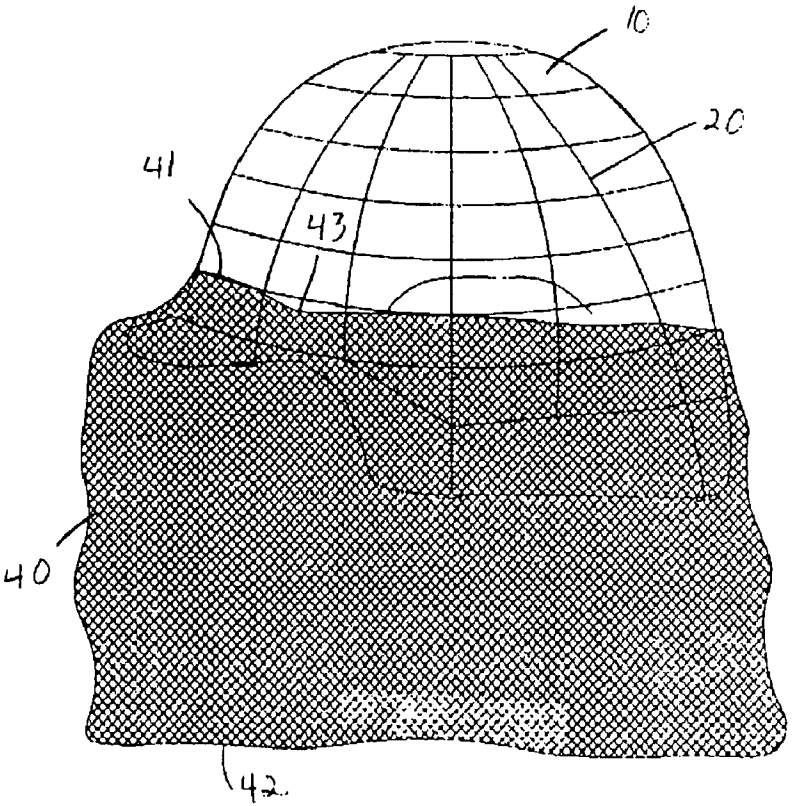
FIG. 5 is a side view of the helmet of FIG. 4 with face/bug net deployed.
Figure 4:
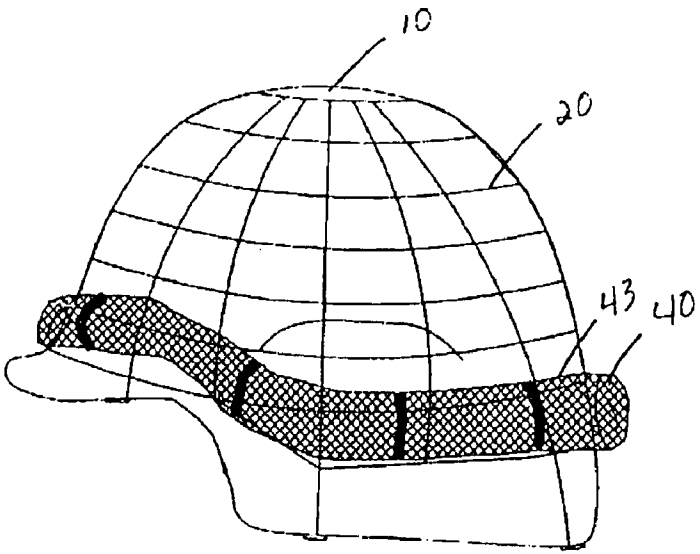
FIG. 4 is a side view of the helmet of FIG. 1 with a face/bug net attached.
Figure 6:
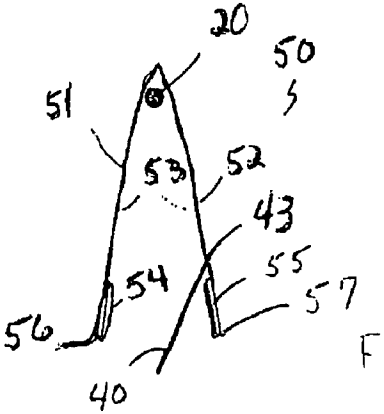
FIG. 6 is a side view of a net connector.

To camouflage the wearer's face, and provide bug protection, a deployable face and bug net 40 may be removably attached to the invention assembly 20. The net 40 may be an "over the brim" design with an upper opening 41, wide enough to fit over the helmet upper portion 14 but not wide enough to fit over the helmet expanded portion 15, and a lower opening 42 wide enough to fit over the helmet expanded portion 15. The net upper opening 41 is connected to a plurality of hook and loop fasteners 50 as shown in FIG. 6. Each fastener 50 is comprised of an elongated fabric strip 51 having an outer surface 52 and an inner surface 53. The fabric strip 51 has a first end 56 and a second end 57, said second end 57 being fixedly attached to a net upper opening edge 43. The inner surface 53 has a hook and loop fastener arrangement comprised of a hook component 54 adjacent said strip first end 56 and a loop component 55 spaced apart from said hook component 54 and adjacent said strip second end 57. The fabric strip 51 is adapted to be looped about a ring, e.g., the fourth ring 24, and a rolled net 40 placed against the strip inner surface 53. The rolled net 40 may then be held in place by joining the hook 54 and loop 55 components. See FIG. 4. The net 40 may be deployed by releasing the hook 54 and loop 55 components. See FIG. 5.

Figure 10:
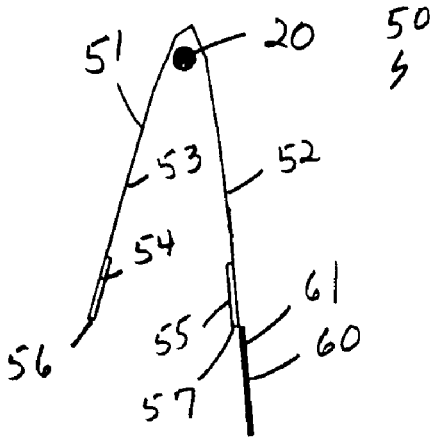
FIG. 10 is a side view of a camouflage strip connector.

The present invention also provides a bundle 60 of camouflage strips which may be stored on the assembly 20 and deployed as desired. The bundle 60 is comprised of a fabric ring 61, either circular or elliptical in shape, with a number of elongated camouflage strips 62 attached thereto. The ring 61 is connected to a plurality of hook and loop fasteners 50 as shown in FIGS. 6 and 10. The fabric strip second end 57 is fixedly attached to said fabric ring 61. The fabric strip 51 is adapted to be looped about said first ring 21 and held in place by joining the hook 54 and loop 55 components. The strip bundle 60 may be removed from the assembly 20 by releasing the hook 54 and loop 55 components.

Figure 7:
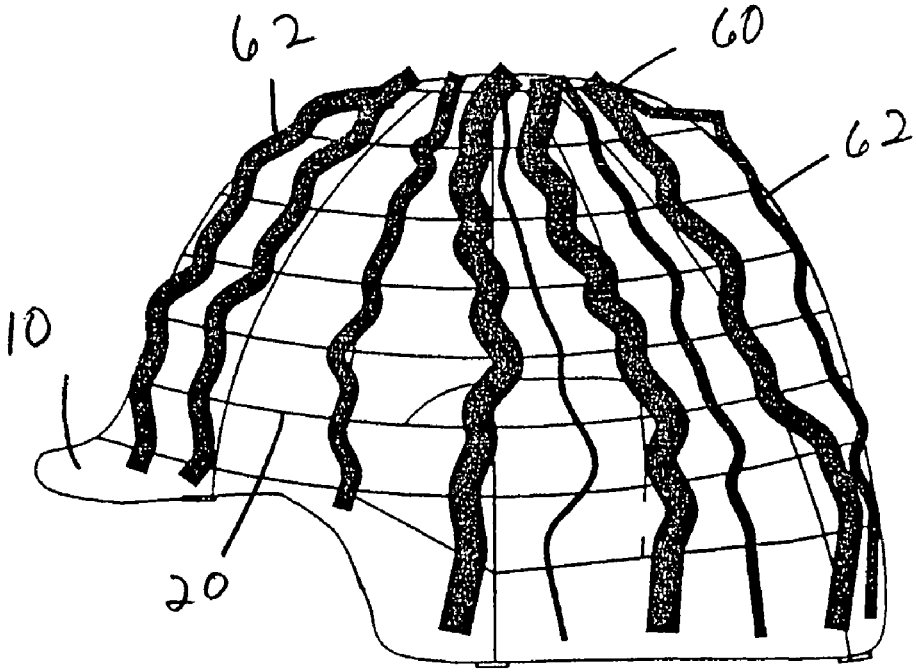
FIG. 7 is a side view of the helmet of FIG. 1 with camouflage strips attached and stored.
Figure 8:
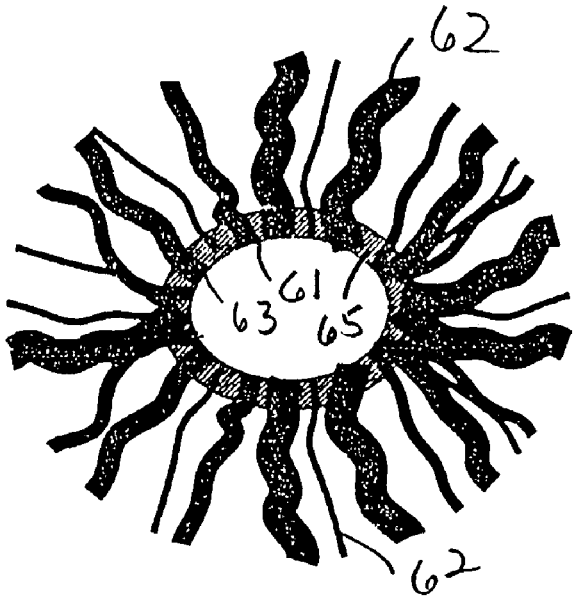
FIG. 8 is a top view of the camouflage strips of FIG. 7.
Figure 9:
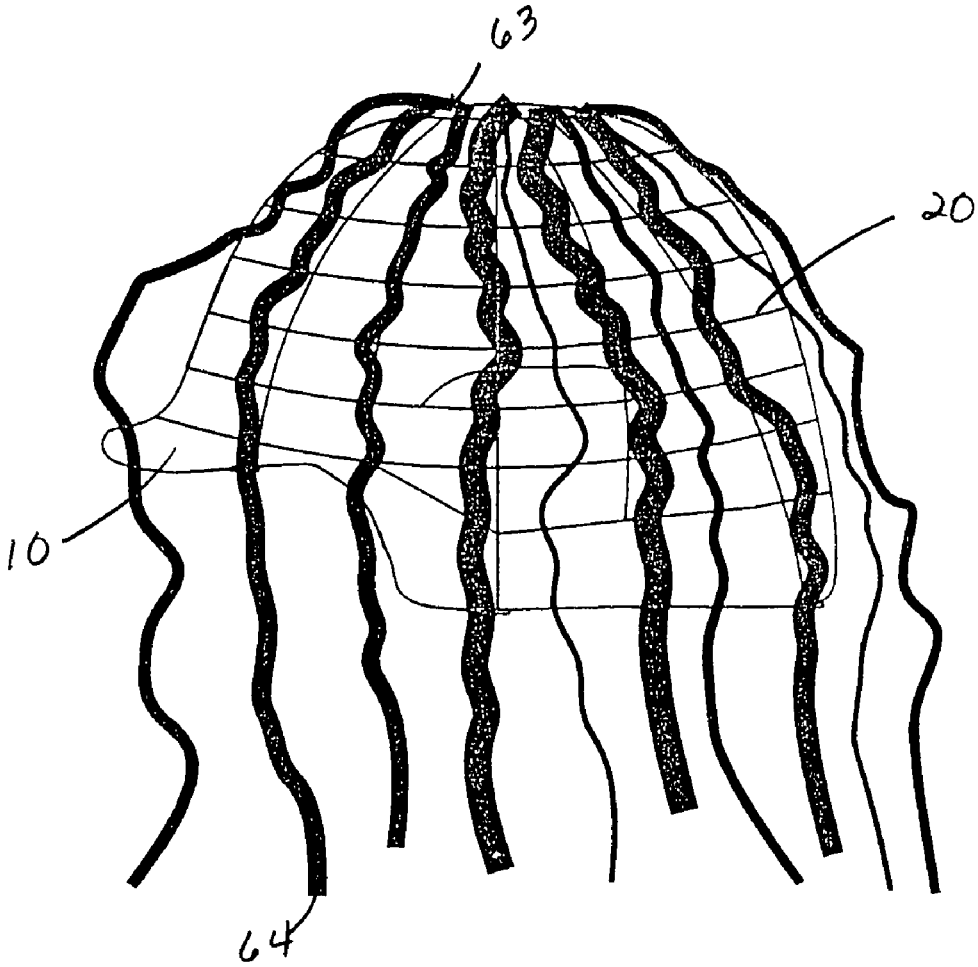
FIG. 9 is a side view of the helmet of FIG. 7 with camouflage strips deployed.

Each elongated camouflage strip 62 has two ends, a first end 63 attached to said ring 61 and a second free end 64. The ring surface 65 has a fastener loop component about its circumference. Each camouflage strip second free end 64 has a fastener hook component attached thereto. In storage, each camouflage strip second free end 64 is attached to the ring surface 65. See FIG. 7. For deployment, the camouflage strip second free ends 64 are released from the ring surface 65 and allowed to deploy over the helmet rim 13. See FIG. 9.

It is understood that the above-described embodiment is merely illustrative of the application. Other embodiments may be readily devised by those skilled in the art which will embody the principles of the invention and fall within the spirit and scope thereof.

I claim:

1. A multipurpose camouflage system used in conjunction with a military helmet, said helmet having a dome with an outer surface and an inner surface, a rim which, along with the inner surface of the dome, defines a cavity for receiving a wearer's head, said dome including an upper portion which fits over the top of a wearer's head and an expanded portion extending from the upper portion of the dome to the rim for covering the sides, forehead and back of the wearer's head, said rim having a perimeter greater than a dome perimeter, said helmet having a forward portion for covering the wearer's forehead, a rearward portion for covering the back of the wearer's head, and opposing sides extending between the forward portion and rearward portion to protect the sides of the wearer's head, comprising:

an elasticized, weatherproof assembly adapted to being attached to said helmet;

a deployable face and bug net removably attached to said helmet; and a bundle of camouflage strips attached to the apex of the helmet and adapted to being deployed over the helmet.

2. A multipurpose camouflage system as recited in claim 1, wherein:

the elasticized, weatherproof assembly has a spider web form beginning with a plurality of elasticized rings with a first ring adjacent to and about the helmet apex and a plurality of remaining rings formed about the helmet dome upper portion and the helmet expanded portion, said plurality of rings being interconnected by a plurality of elasticized helmet connector lines and a plurality of elasticized ring connector lines, said ring connector lines terminating at a last ring about the helmet expanded portion, said helmet connector lines having a portion extending past said last ring toward the helmet rim, said helmet connector line extending portions each terminating in a U-shaped retaining clip comprised of two legs interconnected by a crossbar, each said clip being fitted about the helmet rim.

3. A multipurpose camouflage system as recited in claim 2, further comprising:

an upper opening in said deployable face and bug net having a diameter less than the dome perimeter and less than the rim perimeter;

a lower opening in said deployable face and bug net having a diameter greater than the rim perimeter;

a plurality of fasteners connected to said upper opening, said fasteners adapted to connect with one of said rings.

4. A multipurpose camouflage system as recited in claim 3, wherein:

the bundle of camouflage strips is comprised of a fabric ring with a plurality of elongated camouflage strips attached thereto, said ring being releasably attached to said first ring, each elongated camouflage strip having two ends, a first end attached to said ring and a second free end, said second free end having a fastener attached thereto, said fastener adapted to being releasably attached to said fabric ring.

5. A multipurpose camouflage system as recited in claim 4, wherein:

said plurality of remaining rings is comprised of a second ring formed beneath the first ring about the helmet dome upper portion, a third ring formed beneath the second ring about the helmet dome upper portion, a fourth ring formed beneath the third ring about the helmet dome upper portion, said last ring formed beneath the fourth ring about the helmet expanded portion.

6. A multipurpose camouflage system as recited in claim 5, wherein:

one helmet connector line and two ring connector lines move from the first ring toward each opposing side;

two helmet connector lines and one ring connector line move from the first ring toward the forward portion; and two helmet connector lines and one ring connector line move from the first ring toward the rearward portion.

7. A multipurpose camouflage system as recited in claim 6, wherein:

each said helmet connector line extending portions terminates in an eyelet formed on one of the retaining clip legs.

8. A multipurpose camouflage system as recited in claim 7, wherein:

one retaining clip leg engages the helmet outer surface and the other clip leg engages the helmet inner surface.

9. A multipurpose camouflage system as recited in claim 8, wherein:

the helmet and ring connector lines cross the first ring over the helmet apex.

* * * * *